United States Patent [19]

Meier

[11] 4,144,828

[45] Mar. 20, 1979

[54] SEWING MACHINE WITH A FEED DEVICE

[75] Inventor: Günter Meier, Karlsruhe, Fed. Rep. of Germany

[73] Assignee: Dorina Nahmaschinen GmbH, Fed. Rep. of Germany

[21] Appl. No.: 831,145

[22] Filed: Sep. 7, 1977

[30] Foreign Application Priority Data

Sep. 7, 1976 [DE] Fed. Rep. of Germany ..... 2640174

[51] Int. Cl.[2] ..... D05B 27/00

[52] U.S. Cl. ..... 112/210

[58] Field of Search ..... 112/210, 211, 215, 121.13, 112/221

[56] References Cited

U.S. PATENT DOCUMENTS 3,872,809 3/1975 Adams et al. ..... 112/221

*Primary Examiner*—Ronald Feldbaum

*Attorney, Agent, or Firm*—McGlew and Tuttle

[57] ABSTRACT

A sewing machine has a housing with a needle supported therein for reciprocation upon rotation of a main shaft to move the needle into and out of engagement with a workpiece which is fed by a feed mechanism which is driven from the main shaft. The feed means is such that the material is moved in a plurality of steps while the needle is out of engagement with the workpiece. The feed includes a workpiece support arm which has one end which is pivoted on a slide drive for effecting back and forward movement of the workpiece support arm which includes a feed dog engagement part which engages the workpiece to advance it. An eccentric portion driven from the main shaft provides for the upward and downward movement of the support arm. The transmission and timing of the feed drive is such that the support arm is movable to impart movement to the feed dog engagement portion for the workpiece through the support arm in either four movement cycles in respect to one needle moving cycle, two successive ones of which take place as the needle is moved out of the workpiece and only two take place during the lifting movements of the support arm by the eccentric; or three movement cycles in respect to one needle movement cycle in which the engagement part is given a lifting movement only during two movements in the feed direction during the time the needle is out of the base plate. Drive transmission between the main shaft and the slide drive shaft has a ratio of 1 to 4 and the ratio between the main shaft and the eccentric lifting shaft is 1 to 1 which is effected by a lifting eccentric which carries two cams which are offset either by 90° or 120°.

8 Claims, 3 Drawing Figures

SEWING MACHINE WITH A FEED DEVICE

BACKGROUND OF THE INVENTION

1. Field of the Invention

The invention relates in general to sewing machines and in particular to a new and useful sewing machine with a needle and a fabric feed executing quadrangular movements.

2. Decription of the Prior Art

To obtain, in a sewing machine, a stitch length exceeding the normal feed step of the fabric feed, solutions are known where the work is moved by intermittently operating fabric feeds during the entire stitch forming process of the sewing machine. Thus, for example, from DT-PS 1,175,971 a sewing machine equipped with a lower and an upper feed wheel is known, wherein each feed wheel executes during a stitch forming process two feed steps of equal size, one of which occurs with the needle inserted in the work and the other with the needle extracted from the work.

Another sewing machine known from DT-GM 7,430,111 comprises two lower fabric feeds executing quadrangular movements, one of which executes a feed step while the needle is extracted from the work, and the other together with the needle executes a feed step while the needle has pricked into the work.

The known feed devices cannot be used with household sewing machines, however, because they have only one fabric feed executing quadrangular movements and are moreover equipped with a needle bar which does not participate in the feed movement. The arrangement of a needle bar moving along in feed direction and the installation of an additional fabric feed would not be justified in a household sewing machine for reasons of cost.

SUMMARY OF THE INVENTION

The invention provides a feed device for the work, in particular in household sewing machines, without major structural modification, in such a way that seams can be made with a greater stitch length than heretofore.

The magnitude of the sliding movement of the fabric feed depends on the length of the passage slots provided in the stitch plate for the tooth rows of the fabric feed. However, limits are set to the lengthening of these cutouts insofar as thereby a drawing in of the work to be transported and hence damage to the fabric or a defective stitch formation is carried out. The feed length is therefore generally limited to 4–4.5 mm.

While avoiding the cited disadvantages, the invention permits an increase of the stitch length of the machine substantially beyond the normal by simple means.

With the invention the drive for the fabric feed is designed so that the drive executes a plurality of feed steps during the phase of the needle extracted from the work.

The fabric feed drive may be based on several possible solutions. Thus the drive may impart four movements to the fabric feed during one stitch forming process, of which two successive sliding movements in feed direction fall in the phase of the needle extracted from the work, and only these two sliding movements in a feed directuon coincide with a lifting movement of the lifting drive.

In a sewing machine equipped with a sliding shaft and a lifting shaft for the fabric feed, each driven by the main shaft of the machine, the feed device is advantageously constructed so that the drive transmission between the main shaft and the sliding shaft has a ratio of 1:4. In addition, a lifting eccentric carrying two cams offset by 90° for controlling the lifting of the fabric feed on the lifting shaft which is driven by the main shaft in known manner in the ratio of 1:1.

Alternatively the drive for the fabric feed is constructed so that during one stitch forming process the sliding drive imparts to the fabric feed three movement cycles, of which two sliding movements in a feed direction and the intervening backward movement fall in the phase of the needle operation when the needle is extracted from the work, and only these two sliding movements in feed direction coincide with a lifting movement of the lifting drive.

With this solution, the feed device on a sewing machine equipped with a sliding shaft and a lifting shaft for the fabric feed each driven by the main shaft of the machine can advantageously be arranged so that the drive transmission between the main shaft and the sliding shaft has a ratio of 1:3, and that there is secured on the lifting shaft, driven in known manner in the ratio of 1:1 by the main shaft, a lifting eccentric carrying two cams, offset by 120° and controlling the lifting of the fabric feed.

Although due to the increased speed of the sliding shaft relative to the main shaft of the machine substantially higher acceleration conditions of the fabric feed drive result in the arrangement according to the invention, the values attained still remain far below the values which are handled without objection by the suspension and by the work to be transported.

Due to the double feed step of the fabric feed during one stitch formation, the feed acts shortly before the reinsertion of the needle into the work, owing to which the work is still transported after the moment at which the thread lever has reached the upper dead center of its movement path. As a result, there is exerted on the last formed sewing stitch, after it has already been pulled up by the thread lever, again a thrust whereby the thread knotting of this stitch is pulled tight definitively. Therefore the stitch formation can in this case be carried out with a lower upper-thread tension, owing to which the needle thread is stressed less.

Accordingly it is an object of the invention to provide an improved sewing machine which has a needle mounted in a sewing machine housing for reciprocation under the drive of a main shaft for movement into and out of engagement with a workpiece and which includes feed means driven from the shaft for feeding the workpiece past the needle in a sewing zone in a plurality of steps while the needle is out of engagement with the workpiece and wherein the movement of the workpiece is advantageously effected in four movement cycles in respect to the feed direction two of which take place as the needle is moved out of the workpiece and only two take place during the lifting movement of the needle support of the feed mechanism.

A further object of the invention is to provide a sewing machine which is simple in design, rugged in construction and economical to manufacture.

GENERAL DESCRIPTION OF THE PREFERRED EMBODIMENTS

Figures 1, 2, 3:
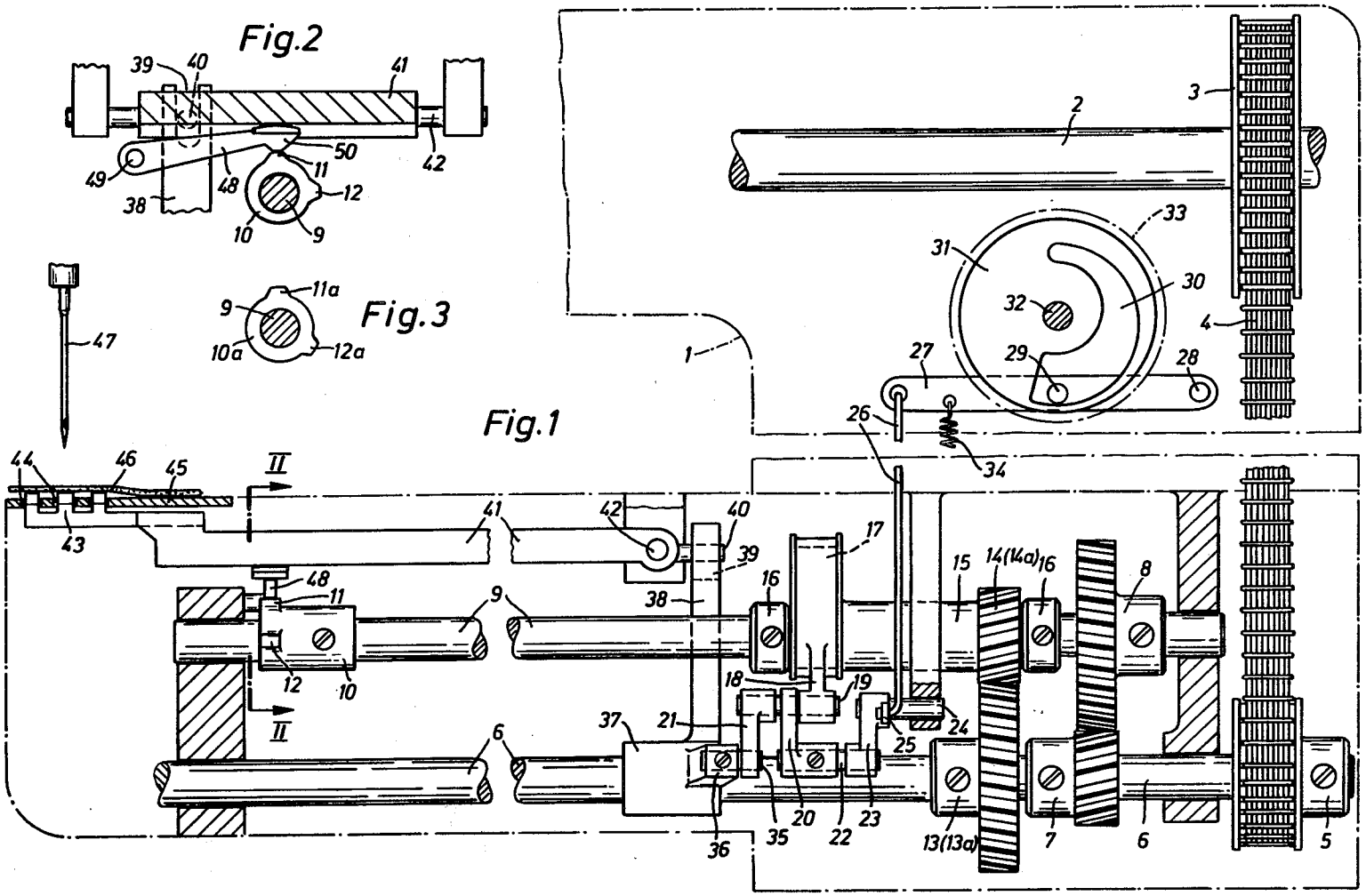
FIG. 1 is a schematic representation of a sewing machine constructed in accordance with the invention.
FIG. 2 is a section taken along the line II—II of FIG. 1.
FIG. 3 is a partial sectional view similar to FIG. 2 showing another embodiment of eccentric.

Referring to the drawings in particular the invention embodied therein comprises a sewing machine having a housing 1 which provides means for mounting a needle 47 for reciprocation into and out of a workpiece 46. The workpiece is advanced by feed means which is driven from a main shaft 2.

The main shaft 2 drives via a sprocket wheel 3, chain 4 and sprocket wheel 5 and a lower shaft 6 in the ratio 1:2. A gear 7 is fastened on the shaft 6 and it meshes with a gear 8 of twice its diameter, which is secured on a shaft 9 mounted parallel to shaft 6. On shaft 9 is screwed fast a lifting eccentric 10, which carries two cams 11 and 12 offset by 90°.

A gear 13 is also secured to shaft 6 and it meshes with a gear 14 of half its diameter which is firmly connected with a hollow shaft 15 mounted on the shaft 9. The hollow shaft 15, axially secured by means of setting rings 16, carries a sliding eccentric 17 which is embraced by an eccentric rod 18 to which two links 20 and 21 are articulated by means of a stud 19. Link 20 is rotatably connected by a stud 22 with an angle lever 23, which lever 23 is rotatably mounted on an axle 24 secured in the housing 1 of the sewing machine and is connected by an arm 25 and a rod 26 with a lever arm 27. The lever arm 27 is supported by means of a stud 28 on the housing 1 of the sewing machine and comprises a stop pin 29 which engages in a groove 30 of a setting disk 31 which is secured on a shaft 32 extending through the housing 1. A setting knob 33, indicated in dash-dot lines is screwed fast to the end of shaft 32 extending out of the housing 1.

An extension spring 34 hooked in at its one end at the lever arm 27, and fastened at its other end to the housing 1 of the sewing machine, biases the stop pin 29 against one wall of groove 30 of the setting disk 31.

By means of a stud 35, link 21 is articulated to an arm 36 of a sliding shaft 37 mounted coaxially on shaft 6. A second, upwardly extending arm 38 of the sliding shaft 37 has at its end a guide slot 39 in which a pin 40 is guided. The pin 40 is fastened on a support arm 41 which is displaceably mounted on a horizontal axle 42 secured in the housing 1 parallel to the feed direction. At its free end the support arm 41 carries a fabric feed 43, which is sewn by a needle 47 driven in known manner by the main shaft 2 in cooperation with a looper (not shown).

The support arm 41 takes support on an intermediate lever 48, which is articulated to the housing 1 by means of a stud 49 and rests on the lifting eccentric 10 by a nose 50 as shown in FIG. 2.

The sewing machine operates as follows:

As the main shaft 2 revolves, shaft 6, driven via the sprocket wheels 3 and 5 and the chain 4, revolves at double the speed. Shaft 6 drives ahaft 9 via gears 7 and 8 at half the speed, so that shaft 9 rotates at the same speed as the main shaft 2.

At the same time shaft 6 drives via gears 13 and 14 the hollow shaft 15 at double the speed, so that its speed is to the speed of the main shafta 2 as 4:1.

During one revolution of the main shaft 2, therefore, the hollow shaft 15 rotates four times. At each revolution of the hollow shaft 15, the sliding eccentric 17 swings the sliding shaft 37 out via the eccentric rod 18 and link 21, whereby the eccentric rod imparts sliding movements to the support arm 41 and hence also to the fabric feed 43 via the arm 38. Hence also four sliding movements of the fabric feed 43 in the feed direction occur during one stitch-forming process. As shaft 9 rotates at the same speed as the main shaft 2, the two cams 11 and 12 of the lifting eccentric, offset by 90°, lift the support arm 41 via the intermediate lever 48 at its free end during two successive sliding movements in the feed direction the teeth of the fabric feed 43 rise over the surface of the stitch plate 45 and come into engagement with the workpiece 46. The adjustment of the lifting eccentric 10 is chosen so that these two feed steps fall in that phase of the stitch forming process in which the needle 47 has left the work 46. In the two sliding movements of the fabric feed 46 in feed direction lying in the inserted phase of needle 47 and in all sliding movements in backward direction no lifting of the support arm 41 takes place.

In this way the work 46 is advanced two feed steps per stitch forming process, a stitch length being attainable which is substantially greater than the feed path of the fabric feed 43 existing in the slots 44 of the stitch-plate 45.

The adjustment of the feed step size of the fabric feed 43 is effected by displacement of the setting knob 33, whereby the groove 30 of the setting disk 31 rotates along. Under the effect of the extension spring 34, the stop pin 29 applies against the outer wall of groove 30 and, via rod 26 and angle lever 23, displaces the stud 22 (which serves as pivot for link 20) relative to stud 19. During the swing-out movement of stud 19 by the eccentric rod 18, therefore, link 20 executes a purely rotational movement around stud 22, whereas link 21 executes a relative movement around stud 35 in addition to this rotational movement. Via the sliding shaft 37 this relative movement is transmitted as a sliding movement to the support arm 41. The latter slides forward and back on the axle 42 and in so doing imparts to the fabric feed 43 fastened at its free end sliding movements whose magnitude depends on the position of the setting disk 31 and hence on the adjustment difference between studs 22 and 35.

Besides the design of the feed device according to the above-described embodiment, additional designs are embraced by the invention. Thus, by changing in the described embodiment the gears 13 and 14 to gears **13*a* and 14*a* having a transmission ratio 1:3 and changing the lifting eccentric 10 to a lifting eccentric 10*a* (FIG. 3) whose cams 11*a* and 12*a* are offset 120°, a feed device can be obtained which executes three sliding movements of the fabric feed 43 in feed direction during one stitch forming process. The lifting eccentric 10*a* should then be arranged on shaft 9 so that the two cams 11*a* and 12*a*, offset by 120°, lift the support arm 41 with the fabric feed 43 after the start and before the end of the phase of needle 47 extracted from the work. At the same time the sliding eccentric 17 should be adjusted so that two of its sliding movements in feed direction coincide with the lifting movements of the fabric feed 43**.

The device according to the invention is, however, not limited to the two embodiments described; additional possibilities can be realized without going outside the scope of the present invention.

Thus, for example, the eccentric transmission 17, 18 in the sliding drive for the fabric feed 43 can be replaced by a positive drive of the fabric feed via a sliding eccentric with cam. In this case it is possible by cooperation of one cam of the sliding eccentric and one cam of the lifting eccentric to execute a plurality of sliding movements in feed direction acting on the work 46 during the extracted phase of needle 47. Between these feed movements there occurs a combined backward and lowering movement of the fabric feed 43, not acting on the work, where in the inserted phase of needle 47 the execution of a single inactive backward movement of the fabric feed 43 is sufficient.

While specific embodiments of the invention have been shown and described in detail to illustrate the application of the principles of the invention, it will be understood that the invention may be embodied otherwise without departing from such principles.

What is claimed is:

1. In a sewing machine having a housing, a needle which is reciprocated on said housing at a sewing station zone into and out of engagement with a workpiece, a main machine shaft connected to said needle through a continuous drive connection to reciprocate said needle, the inmprovement comprising feed means connected to the main machine shaft for feeding the workpiece past the needle at the sewing zone, transmission means provided between said feed means and the main machine shaft to cause said feed means to perform a plurality of feed steps while the needle is out of engagement with the workpiece.

2. In a sewing machine having a housing, a needle which is reciprocated on said housing at a sewing station zone into and out of engagement with a workpiece, a main machine shaft connected to said needle to reciprocate said needle, the improvement comprising feed means for feeding the workpiece past the needle at the sewing zone in a plurality of steps while the needle is out of engagement with the workpiece, said feed means including a workpiece support arm having one end which is pivoted on said housing and an opposite end engageable with the workpiece, an eccentric drive shaft connected to said main shaft for rotation thereby and having an eccentric portion engageable with the support arm to raise and lower said support arm in timed relationship to the movement of said needle, a slide drive connected to said shaft for back and forth movement thereby and pivotally supporting said one end of said support arm and being movable to impart movement to the workpiece through said support arm in four movement cycles in respect to one needle moving cycle, two successive ones of which take place as the needle is moved out of the workpiece and only these two take place during the lifting movement of the said support arm by said eccentric portion.

3. A sewing machine according to claim 2, including a slide shaft connected to said main shaft for rotation thereby comprising part of said slide drive, the drive transmission between said main shaft and said slide shaft being in the ratio of 1:4, said eccentric drive shaft being driven by said main shaft in the ratio of 1:1, said eccentric portion comprising a lifting eccentric on said eccentric shaft having two angularly spaced cams offset by 90° engageable with said support arm for raising and lowering said arm with the workpiece thereon.

4. In a sewing machine having a housing, a needle which is reciprocated on said housing at a sewing station zone into and out of engagement with a workpiece, a main machine shaft connected to said needle to reciprocate said needle, the improvement comprising feed means for feeding the workpiece past the needle at the sewing zone in a plurality of steps while the needle is out of engagement with the workpiece, said feed means including a workpiece support arm having one end which is pivoted on said housing and an opposite end engageable with the workpiece, an eccentric drive shaft connected to said main shaft for rotation thereby and having an eccentric portion engageable with the support arm to raise and lower said support arm in timed relationship to the movement of said needle, a slide drive connected to said shaft for back and forth movement thereby and pivotally supporting one end of said support arm and being movable to impart movement to the workpiece through said support arm, said slide imparting to said fabric three movement cycles in respect to one needle movement cycle of which two sliding movements in a feed direction and the intervening backward and forward movement take place when the needle is out of the workpiece and only two sliding movements in the feed direction coincide with the lifting movement of said support arm.

5. In a sewing machine according to claim 4, wherein said slide drive includes a slide shaft, the drive transmission between said main shaft and said slide shaft being in the ratio of 1:3 and the transmission between the main shaft and the eccentric drive shaft being in the ratio of 1:1, said eccentric portion comprising a known lifting eccentric having two cams offset by 120° engageable with said support arm in timed relationshop to raise and lower it.

6. In a sewing machine having a housing, a needle which is reciprocated on said housing at a sewing station zone into and out of engagement with a workpiece, a main machine shaft connected to said needle to reciprocate said needle, the improvement comprising feed means for feeding the workpiece past the needle at the sewing zone in a plurality of steps while the needle is out of engagement with the workpiece, said feed means comprising a feed dog having an engagement part for engaging the workpiece; a needle plate for supporting the workpiece and secured to the housing, and having a slot for the passage of said engagement part therethrough for the passage of the needle therethrough, first drive means which are actuated by the main shaft and connected to the feed dog in order to impart back and forth movements of said feed dog coinciding in time with the movement of the needle; second drive means connected to said main shaft and connected to said feed dog to impart up and downward movements thereto coinciding in time with the movement of said needle, of said feed dog engagement part being moved into positions beneath and above the surface of said needle plate; said first drive means imparting to said feed dog, during a cycle of the needle movement, four movement cycles of which two successive movement portions are in the feed direction and at least the intervening backward movement portion take place during the period of time the needle is out of said needle plate; said second drive means imparting a lifting motion to said feed dog only during the said two movement portions in the feed direction within the period of time the needle is out of the needle plate, in order to lift said engagement part above the surface of the needle plate.

7. In a sewing machine having a housing, a needle which is reciprocated on said housing at a sewing station zone into and out of engagement with a workpiece, a main machine shaft connected to said needle to reciprocate said needle, the improvement comprising feed means for feeding the workpiece past the needle at the sewing zone in a plurality of steps while the needle is out of engagement with the workpiece, said feed means comprising a feed dog having a part for engaging the workpiece; a needle plate for supporting the workpiece secured to said housing and provided with a slot for the passage of said engagement part and said needle; first drive means connected to said main shaft and connected to said feed dog in order to impart back and forth movements thereto in the feed direction coinciding in time with the movement of the needle; second drive means connected to said main shaft and connected to said feed dog to impart up and downward movements coinciding in time with the movement of the needle to said feed dog, said engagement part being moved into positions beneath and above the surface of the needle plate; said first drive means imparting to the feed dog, during a cycle of needle movement, three movement cycles of which two movement portions in the feed direction and the intervening backward movement portion take place during the period of time in which the needle is out of the needle plate; said second drive means imparting a lifting movement to said feed dog only during the said two movement portions in the feed direction within the period of time in which the needle is out of the needle plate, in order to lift the part engageable with the workpiece of the feed dog above the surface of the needle plate.

8. In a sewing machine having a housing, a needle which is reciprocated on said housing at a sewing station zone into and out of engagement with a workpiece, a main machine shaft connected to said needle to reciprocate said needle, the improvement comprising feed means for feeding the workpiece past the needle at the sewing zone in a plurality of steps while the needle is out of engagement with the workpiece, said feed means including a feed dog engagement portion connected to said main shaft for upward and downward and back and forth movement in timed relationship to the movement of said needle to impart movement to the workpiece in four movement cycles in respect to one needle moving cycle, two successive ones of which take place when the needle is moved out of the workpiece and only these two take place during the lifting movement of said feed dog.

* * * * *